United States Patent [19]

de Graaf

[11] 4,149,706

[45] Apr. 17, 1979

[54] SLAG SHIELD FOR A STEEL CONVERTER

[75] Inventor: Jan A. de Graaf, Heemskerk, Netherlands

[73] Assignee: Hoogovens Ijmuiden, B.V., Ijmuiden, Netherlands

[21] Appl. No.: 883,744

[22] Filed: Mar. 6, 1978

Related U.S. Application Data

[63] Continuation of Ser. No. 775,474, Mar. 8, 1977, abandoned.

[30] Foreign Application Priority Data

Mar. 8, 1976 [NL] Netherlands ..... 7602385

[51] Int. Cl.[2] ..... C21C 5/46

[52] U.S. Cl. ..... 266/243; 266/903

[58] Field of Search ..... 266/241, 243–246, 266/903

[56] References Cited

U.S. PATENT DOCUMENTS 3,799,524 3/1974 Menu ..... 266/241

*Primary Examiner*—Gerald A. Dost

*Attorney, Agent, or Firm*—Stevens, Davis, Miller & Mosher

[57] ABSTRACT

Slag shield for a steel converter, comprising a ring of conically set segments around the upper end of the converter. The conically set segments are each provided with two hook-carrying brackets. The hooks near the lower end of the slag shield catching around horizontal bars which are connected around and to the converter. Each segment is held with its upper edge close against the converter vessel by fastening means, which are locally provided on the vessel wall. The fastening means allow for small displacements of the segment in its own plane.

4 Claims, 4 Drawing Figures

HO 279

Hoogovens IJmuiden BV IJmuiden

SLAG SHIELD FOR A STEEL CONVERTER

This is a Continuation of application Ser. No. 775,474 filed Mar. 8, 1977 now abandoned.

The invention relates to a slag shield for a steel converter comprising a ring of segments located around the upper side of the converter in an inclined position relative to the converter axis.

Steel converters, especially those of the type which are used for steel production processes in which oxygen is blown from a lance onto the bath, or through a bottom brick through the bath, are as a rule hung in a so-called mantle ring, said mantle ring being again itself hung rotatably in trunnions. Special measures are required in order to prevent splashing slag or falling fragments from possibly fouling or even damaging the mantle ring and the trunnions. For that purpose, as a rule, a so-called slag shield of the type indicated as known is provided. One usual construction of such a slag shield is a conically shaped hood made of one single element which is welded around and to the vessel, or which is mounted on the mantle ring in such a way that the slit between this shield and the converter vessel is closed by means of a second shield which has the shape of a conical hood and which is welded round and to the converter vessel.

It has been found that these known constructions have the disadvantage that the long welded joint, by which the shield is connected to the converter vessel, has a poor viability. In practice it is found that the extreme differences in temperature which occur near this welded joint may make multiple repairs ncessary.

The invention has as an object to provide a construction in which this disadvantage is avoided. Another object of the invention is to provide a construction in which the slag shield, or parts thereof, may easily be dismantled, and which nevertheless may provide improved shielding against slag and ash particles.

The invention therefore consists in that in a slag shield of the known type the conically set segments are each provided with two brackets, each carrying a hook, said hooks catching around pins which are provided horizontally around and are fixed to the converter vessel near the lower end of the slag shield, and further that each segment is held with its upper rim close to the converter vessel by means of fastening means which are connected locally to the vessel wall, the fastening means allowing for a small displacement of the said segment in its own plane.

This novel slag shield as a whole is not connected to the mantle ring, but only to the converter vessel. The segments may be hooked on in a simple way, while separate means are not required to cover a slit between the segments and the vessel wall. The welded joint has in this case been replaced by local fastening means in which nevertheless no undesired thermal stresses may occur as a consequence of changes in temperature. Mutual differences in thermal expansion between the vessel wall and the segments may be accommodated by the capability for displacement of each segment it its own plane with respect to the fastening means provided at the vessel wall.

It has been found that a particularly suitable construction of these local fastening means is obtained if they consist of pins which are connected, in a direction transverse to a segment, to the vessel wall and which each fit with play through a hole in the segment, and in which the segment is kept in place on the pins by a ring which fits onto each pin and which is connected thereto. This ring may be connected to the pin by means of a screwthread or by means of a split pin or similar device, but it has been found that in practice preference is to be given to a welded joint between the ring and the pin which may easily be taken apart again. Such a joint is found in practice to be least sensitive to failure or damage resulting from splashing liquid slag, or to adherence of such slag.

As each segment is hung by means of two hooks, one single connection means per segment comprising a pin and a ring could be sufficient. However, it has been found that a construction in which each segment is connected by two pins is to be preferred.

It is known to close the transition of one segment to the next one by welding a strip to the adjacent segments to cover this transition. Again because of the high thermal stresses which may occur in the construction, preference is to be given to a slag shield construction in which alternate segments are provided along their sides with raised rims which overlap the adjacent segments.

The new construction of the slag shield has been found to be simpler in that it may be fixed with means which need less space. This again has made it possible to connect the shield in a steeper position, relative to the converter axis which results in the clear advatage that slag and fragments which fall upon the shield adhere less and slide down more easily and hence cause less fouling. Preferably the segments should form an angle with the converter axis of between 30° and 40°.

The invention will be described below with reference to some figures.

Figure 1:
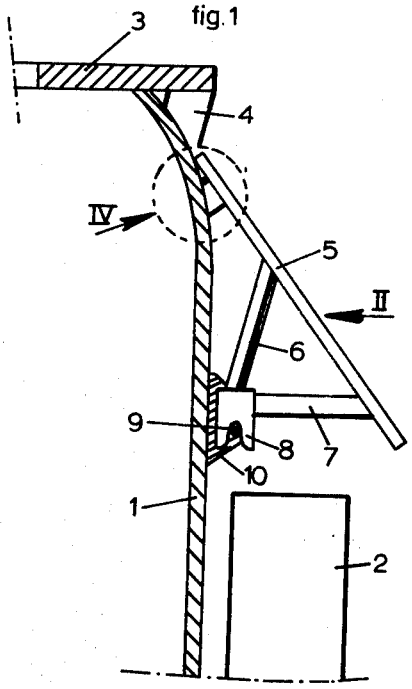
FIG. 1 shows the connection of a slag shield to a converter vessel schematically in cross-section.

In the various figures reference numeral 1 indicates the vessel wall of the converter. Around the converter vessel, a mantle ring 2 has been connected in a manner known per se. Along its upper rim the vessel is provided with a flat flange 3, which is rigidly connected to the vessel wall by means of strips 4. It is remarked that the construction of the converter vessel with the mantle ring and the flange 3 as indicated is not essential for the present invention.

Figure 3:
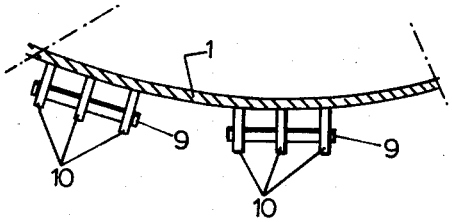
FIG. 3 is a cross-section according to III—III in FIG. 2.

In FIG. 1 one of the segments 5 from the series of segments **5*a*, 5*b*, 5*c*, etc. is shown with a bracket consisting of two pipes 6 and 7 which are welded to the segment, and to which the hook-shaped plate 8 is connected. The hook-shaped plate 8 catches around a pin 9 (also see FIG. 3) which again is connected to the vessel wall 1 by means of three plates 10, in the case illustrated. Two of the brackets illustrated are provided per segment, one near each of the side edges of a segment 5**.

The segments 5, which are set in a conical shape corresponding to the shape of the vessel, extend at their upper end against the vessel wall 1.

Figure 4:
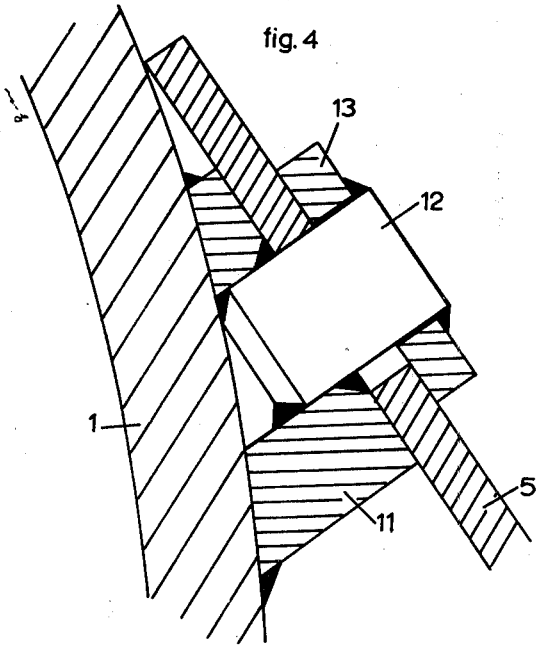
FIG. 4 shows the detail according to IV in FIG. 1 on an enlarged scale.

In FIG. 4 it is shown in detail how segment 5 has been connected near its upper end to vessel wall 1. For this purpose first of all pins 12 have been welded to the vessel wall by means of rings 11. Pins 12 extend through a hole in segment 5 which is much greater than the pin diameter which allows for a relative movement of segment 5 in its own plane with respect to pin 12, which again facilitates mounting the segment and also provides for a capability of compensating for the deformation resulting from temperature differences. Segments 5 cannot move in the longitudinal direction of the pins, because of a closing ring 13, which is connected to pin 12 by means of a simple portable welded joint.

Figure 2:
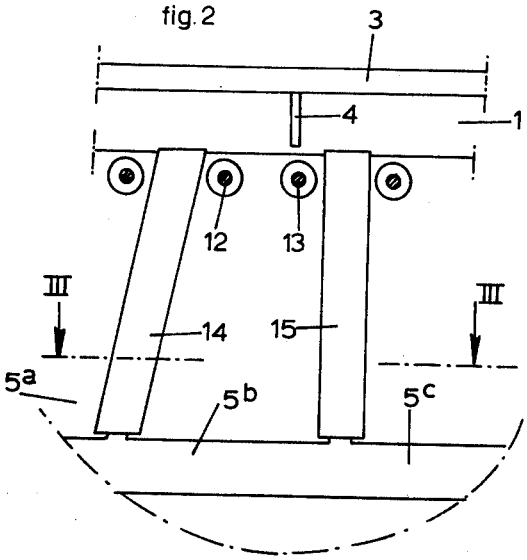
FIG. 2 is a view according to II in FIG. 1.

In FIG. 2, it is shown how strips 14 and 15 are welded to segments 5*a* and 5*c*, overlapping the side edges of segment 5*b*. This provides a simple closure against slag and dust, while every alternate segment may yet be removed and replaced by a new one in a simple manner.

I claim:

1. Slag shield for a steel converter, comprising a ring of segments around the upper end of the converter, which are provided in an inclined position with respect to the converter axis, said segments each being conically set and provided with two hook-carrying brackets, said hooks near the lower end of the slag shield catching around horizontal bars which are connected around and to the converter, each segment being held with only its upper edge close against the converter vessel by fastening means, which are locally provided on the vessel wall, said fastening means allowing for small upwardly and downwardly displacements of the segment in its own plane and each alternate segment having lateral sides to each of which is fixed a strip which extends beyond said lateral side and overlaps the lateral side of the adjacent segment to form a closed ring of segments.

2. Slag shield according to claim 1 wherein the local fastening means consist of at least one pin which is connected to the vessel wall in a direction transverse to a segment, said pin fitting with play through a hole in the segment, said segment being kept on the pin by means of a ring which fits over said pin and is connected thereto.

3. Slag shield according to claim 2 wherein two pins are connected to each segment with each pin fitting with play through a hole in the segment.

4. Slag shield according to claim 1 wherein the segments are positioned at an angle of between 30° and 40° with respect to the converter axis.

* * * * *